US008985844B2

(12) United States Patent
Grimm

(10) Patent No.: US 8,985,844 B2
(45) Date of Patent: Mar. 24, 2015

(54) DEVICE FOR DISPERSING OR HOMOGENIZING WITH A MAGNETIC COUPLING DRIVE FOR ROTORS IN A CHAMBER

(75) Inventor: Uwe Grimm, Bad Krozingen (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 1060 days.

(21) Appl. No.: 12/742,528

(22) PCT Filed: Nov. 3, 2008

(86) PCT No.: PCT/EP2008/009272

§ 371 (c)(1),
(2), (4) Date: May 12, 2010

(87) PCT Pub. No.: WO2009/062610

PCT Pub. Date: May 22, 2009

(65) Prior Publication Data

US 2010/0260008 A1 Oct. 14, 2010

(30) Foreign Application Priority Data

Nov. 12, 2007 (DE) ..... 10 2007 054 233

(51) Int. Cl.
*B01F 13/08* (2006.01)
*B01F 15/06* (2006.01)
(Continued)

(52) U.S. Cl.
CPC ..... *B01F 15/065* (2013.01); *B01F 5/0683* (2013.01); *B01F 7/00241* (2013.01);
(Continued)

(58) Field of Classification Search
CPC ..... B01F 5/0683; B01F 7/00766; B01F 13/0836; B01F 13/0827
USPC ..... 417/420; 416/3; 435/302.1; 366/273–274, 197–205, 207, 314, 331, 366/349, 303–304; 464/29; 403/DIG. 1
See application file for complete search history.

(56) References Cited

U.S. PATENT DOCUMENTS 2,882,149 A * 4/1959 Willems ..... 241/80
3,940,115 A * 2/1976 Zipperer ..... 366/303
(Continued)

FOREIGN PATENT DOCUMENTS

DE 1982247 3/1968
DE 1453760 1/1969
(Continued)

OTHER PUBLICATIONS

Wallrodt, Christian, "Spalttopf auf den Kopf Gestellt", Achema Highlights 2006, Chemietechnik, pp. 1-2, http://www.chemietechnik.de/ai/resources/284097a9622.pdf>.

*Primary Examiner* — Charles Cooley
(74) *Attorney, Agent, or Firm* — Volpe and Koenig, P.C.

(57) ABSTRACT

A device (1) that is used to disperse or homogenize according to the flow-through principle, that includes at least one tool having a rotor (2) and a stator (3), expediently, several tools of this type that are arranged in an axial manner behind one another, that are arranged in a chamber (4) through which a medium that is to be treated flows. The rotor(s) is/are driven by a motor (6) via a magnetic coupling (5) and the magnetic coupling (5) has a stationary separating can (9) between a drive-sided, rotationally-driven drive coupling part (7) and a driven coupling part (8), such that expensive cooled shaft seals can be avoided. The drive coupling part (7) that is on the drive side engages in a recess-shaped or hollow cylindrical driven coupling part (8) that is on the driven side and the separating can (9) is arranged between the coupling parts. As a result, the driven coupling part (8) and the separating can are cooled by the medium that is processed.

13 Claims, 2 Drawing Sheets

(51) Int. Cl.

| | |
|---|---|
| ***B01F 5/06*** | (2006.01) |
| ***B01F 7/00*** | (2006.01) |
| ***B01F 13/10*** | (2006.01) |
| *B01F 3/08* | (2006.01) |
| *B01F 3/12* | (2006.01) |
| *B01F 15/00* | (2006.01) |

(52) U.S. Cl.

CPC ..... *B01F7/00766* (2013.01); *B01F 13/0827* (2013.01); *B01F 13/1013* (2013.01); *B01F 13/1016* (2013.01); *B01F 2003/0846* (2013.01); *B01F 2003/125* (2013.01); *B01F 2015/00084* (2013.01); *B01F 2015/062* (2013.01)

USPC ..... 366/273; 366/304; 366/331

(56) References Cited

U.S. PATENT DOCUMENTS

| | | | | |
|---|---|---|---|---|
| 4,915,509 | A * | 4/1990 | Sauer et al. | 366/171.1 |
| 5,931,579 | A * | 8/1999 | Gallus et al. | 366/163.2 |
| 7,186,018 | B2 * | 3/2007 | Burak | 366/273 |
| 8,079,752 | B2 * | 12/2011 | Rausch et al. | 366/178.2 |
| 8,702,298 | B2 * | 4/2014 | Sei | 366/136 |
| 2004/0191667 | A1 | 9/2004 | Kurokawa et al. | |
| 2007/0133349 | A1 * | 6/2007 | Burak | 366/273 |
| 2010/0260008 | A1 * | 10/2010 | Grimm | 366/273 |
| 2013/0189311 | A1 * | 7/2013 | Rueckl et al. | 366/337 |

FOREIGN PATENT DOCUMENTS

| | | | | |
|---|---|---|---|---|
| DE | 202006005189 | | 9/2007 | |
| EP | 0291819 | | 11/1988 | |
| EP | 0291820 | | 11/1988 | |
| EP | 617999 | A1 * | 10/1994 | B01F 13/08 |
| EP | 673677 | A1 * | 9/1995 | |
| EP | 1475566 | | 11/2004 | |
| EP | 2180583 | A1 * | 4/2010 | |
| JP | 59-166231 | A * | 9/1984 | |
| WO | 9632592 | | 10/1996 | |

* cited by examiner

DEVICE FOR DISPERSING OR HOMOGENIZING WITH A MAGNETIC COUPLING DRIVE FOR ROTORS IN A CHAMBER

BACKGROUND

The invention relates to a device for dispersion or homogenization according to the continuous-flow principle with at least one tool that includes a rotor and stator and that is arranged within a chamber carrying a flow of the medium to be processed, wherein the bearing of the rotor or the rotors is arranged in the chamber and the rotor or rotors is/are driven by a magnetic coupling that has a stationary separating can closing the chamber in the coupling region between a drive-side, rotationally-driven drive coupling part and a secondary driven coupling part.

In the case of such continuously operating devices for dispersion or homogenization, there is the problem that a seal is necessary between the chamber carrying a flow of medium or the work space carrying a flow of medium and the drive, wherein this seal presents problems primarily at high rotational speeds, pressures, and high temperatures and can be very expensive.

Therefore, it is already known to use a separating can for driving a magnetic coupling and for closing the work chamber.

In the case of devices and apparatuses driven by magnetic couplings, the problem can arise that the generated high temperatures, in particular, also in the region of bearings and in the region of the separating can arranged between the parts of the magnetic coupling can be controlled only with difficulty due to the eddy currents occurring there primarily at high outputs, pressures, and rotational speeds.

SUMMARY

Thus the objective arises to create a device of the type noted above or a dispersion device, wherein the problem of the seal between the drive and work chamber is solved in a known way by a magnetic coupling and nevertheless a bearing shall be made possible that can operate satisfactorily also under high pressures, rotational speeds, and temperatures.

To meet this objective, the device defined above is characterized in that the drive-side drive coupling part as a magnetic carrier engages in the recessed or hollow, driven-side driven coupling part, wherein, between the two coupling parts, the separating can is arranged such that the outer driven coupling part carries the drive shaft located in the chamber for the rotor or rotors or is connected to this drive shaft and such that the bearing or bearings for the rotor or rotors carried by the drive shaft is/are arranged within the chamber carrying a flow of medium adjacent to the rotor or rotors.

Here, for the transmission of the drive power it is especially favorable when the drive coupling part is cylindrical and the driven coupling part has a matching hollow cylindrical construction.

In this way it can be achieved that by feeding the medium, when it is processed the bearings are lubricated and cooled by this medium, so that high pressures, rotational speeds, and temperatures can also be handled.

Here it is important that the bearing/bearings is/are arranged in the flow zone of the medium, so that it/they is/are directly exposed to this medium and cooled well accordingly. One preferable and advantageous construction of the invention provides that, on at least one of the bearing parts that can move relative to each other, there is at least one groove or similar impression for feeding medium to be dispersed through the bearing/bearings. Through this measure, the lubrication and cooling of the bearing or bearings can be further aided.

For a precise support and for, in particular, high rotational speeds, it is favorable if a bearing or sliding bearing is provided on both sides of at least one rotor. Thus, such a rotor is not cantilevered, but instead mounted on both sides with corresponding precision, which allows tighter gaps and thus better dispersion and homogenization effects between the rotor and stator.

A larger output can be achieved if at least two or three coaxial rotors are each provided with associated stators, wherein one is supported in a cantilevered manner, or if two or all of the rotors are arranged between at least two bearings, which can be more precise than a cantilevered support.

It can be especially favorable for a high output when the shaft attaching to the drive coupling part carries two bearings and a third rotor supported in a cantilevered manner on its end that faces away from the coupling and that projects past the second bearing. Only two bearings are to be provided and cooled and nevertheless, three rotors can be provided with their stators. A medium can be dispersed or homogenized continuously in a corresponding effective way, wherein the coaxial arrangement of the multiple rotors necessarily produces a corresponding direction of flow of the medium through the chamber or through the work space and in this way onto the corresponding bearings.

Another preferred and advantageous construction of the invention provides that the driven coupling part has at least one passage or multiple passages to the separating can and at least one outlet to an output opening of the chamber or the work space. In this way it is possible that the medium also charges or flushes the separating can before it is led to the output from the chamber or from the work space, so that the separating can could also be cooled by the medium.

Good cooling of separating can is important primarily for quickly running dispersion machines and the resulting high eddy currents in metallic separating cans.

Here, the outlet can be on the driven coupling part whose opening can be on the free edge of this driven coupling part, wherein the separating can engages in this opening. Thus, a ring-shaped gap is produced on the end or edge of the driven coupling part facing the separating can.

By feeding the medium with the help of the rotors that process it through the chamber or the work space, a practically arbitrary orientation of this work space is possible, for example, a horizontal arrangement.

A modified embodiment can be provided, however, in that the rotor shaft is arranged pointing upward above the drive and the magnetic coupling and the inlet through an inlet opening into the chamber or the work space is provided above the uppermost rotor in this arrangement. Then a downward-directed path is produced for the medium to be processed, wherein this path could also be, for example, vertical. This is especially favorable for the cooling effect on the separating can, because this can be charged by the processing medium with corresponding intensity.

So that the device is also suitable primarily for high temperatures, without having to use unsuitable or very expensive or complicated roller bearings, it is preferred when the bearings are sliding bearings, in particular, ceramic bearings, e.g., made from silicon carbide, wherein the bearing sleeve rotating with the shaft is arranged on a metal connection pipe that is located between the bearing sleeve and the shaft and that has an inner diameter somewhat enlarged relative to the shaft across a part of the bearing width and/or at least one slot running in the axial direction or at an angle to the axial direction, wherein the width of this connection pipe is, in particular, larger than the expansion to be expected due to heat. Thus, expansions due to heat and also different coefficients of thermal expansion can be compensated, because the different inner diameters and/or the slot permit different expansions due to heat in the actually interacting parts, so that, for example, an inner steel connection pipe part does not force open a ceramic bearing sleeve. Advantageously, ceramic bearing sleeves can also be used that have a high resistance to temperature and wear.

The rotors and the bearing sleeves can be arranged coaxially one next to the other and/or contacting each other on the drive shaft and can be tensioned together in the axial direction through a compressive force. This produces a simple assembly and allows a practical drive shaft that is practically continuous with respect to its diameter and on which, on one side, the rotors and, on the other side, the bearing sleeves can be arranged coaxially one next to the other. Here it is possible that the bearing sleeves have, on one end, a stop and a beveled or rounded section that features the stop in negative form, so that the axial contact forces of the bearing sleeve on the stop can also produce radial fixing and centering.

The stationary bearing bushing that is made, in particular, from ceramic, in the corresponding sliding bearing can be arranged in a metallic holder that recedes outward from the bearing bushing under heating due to its larger coefficients of thermal expansion and an outer ring that is slotted or that is divided into multiple parts could be provided on the outside of the bearing bushing, wherein this outer ring is pressed by a spring force or springs onto the bearing bushing. Thus, for the bearing bushing, under different expansion due to heat in each expansion phase, a good radial fixing or holding that is flexible on the outside to compression or restoring forces can also compensate the different expansions of the bearing bushing due to heat.

For the axial tensioning of the rotors and the bearings on the free end of the shaft facing away from the magnetic coupling, an expansion screw engaging in this end can be provided, wherein this screw engages over an expansion sleeve that is supported on the parts lined up on the shaft. In this way, tensioning the expansion screw can generate the desired compression force in the axial direction on the parts lined up on the shaft. The use of an expansion screw can take into consideration in advance that this biasing is also maintained at high temperatures and corresponding temperature fluctuations.

Feeding the medium through the chamber or the work space can be simplified in that the holders of the bearings have openings or are formed from individual webs. The medium can also be fed through these holders of the bearings in a correspondingly good way.

Primarily for the combination of individual or multiple features and elements described above, a device for dispersion or homogenization is produced that allows high outputs, because high temperatures can be taken into consideration, without the sealing of the work space requiring complicated, for example, cooled shaft seals, for example, in the form of sliding ring seals.

BRIEF DESCRIPTION OF THE DRAWINGS

An embodiment of the invention is described in detail below with reference to the drawings. Shown, in part, in a schematic diagram are.

DETAILED DESCRIPTION OF THE PREFERRED EMBODIMENTS

Figure 1:
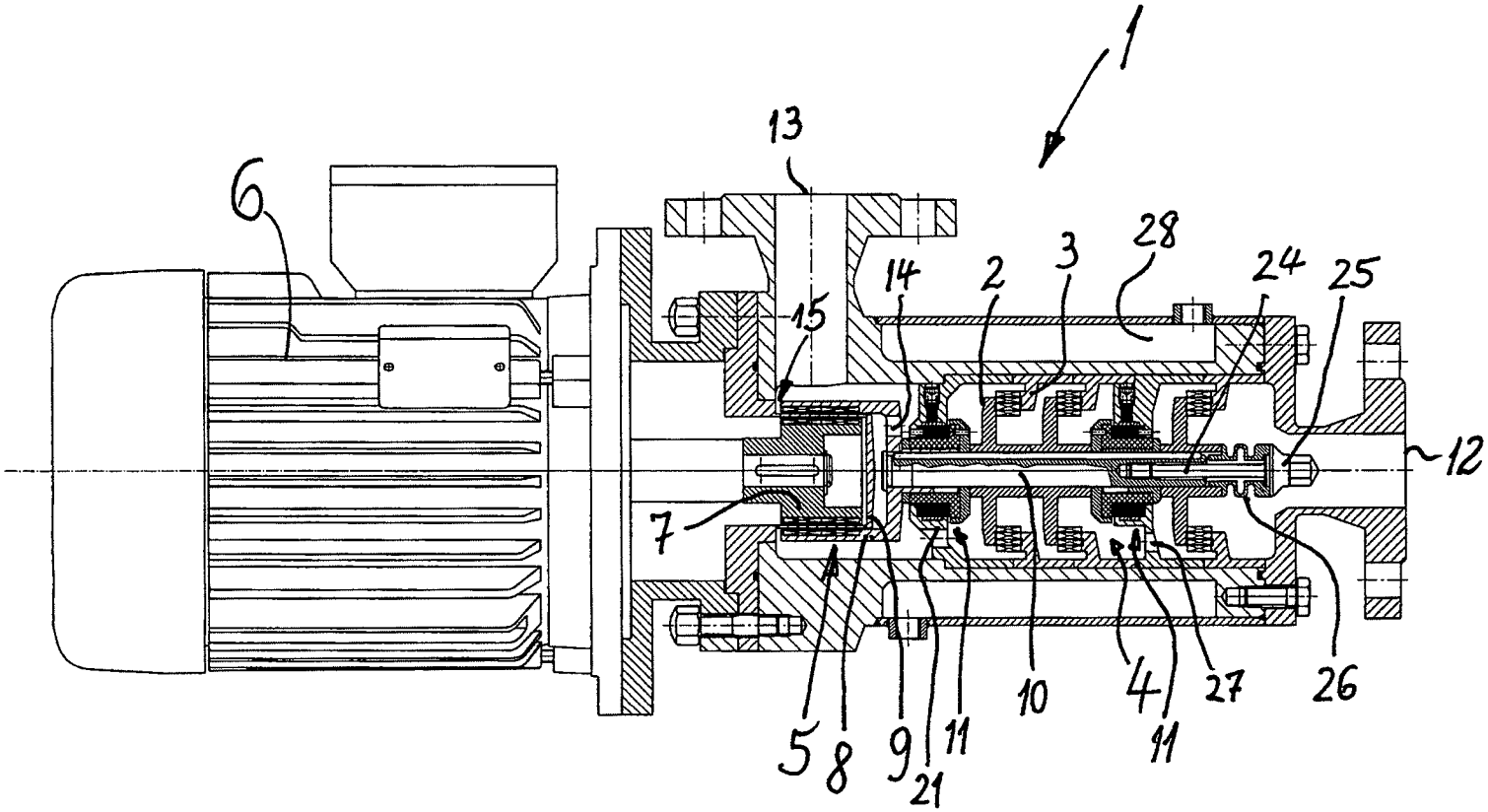
FIG. 1 is a longitudinal view, partially in cross-section, of a device according to the invention for dispersion or homogenization with a drive motor and a chamber that carries a flow of medium and in which tools made from rotors and stators are arranged, wherein a magnetic coupling is provided between the drive and the tools.

A device designated as a whole with 1 is used for dispersion or homogenization according to the continuous-flow principle and is designated below also as dispersion device 1. For the processing of a medium, it has a total of three tools that are made from rotors 2 and stators 3 and that are arranged within a chamber 4 that carries a flow of medium to be processed and that is also referred to as "work space 4" below.

The bearing, still to be described, for the rotors 2 is arranged in the chamber 4, and the rotors 2 are driven by the drive motor 6 by a magnetic coupling designated as a whole with 5. The magnetic coupling 5 here has a stationary separating can 9 hermetically sealing the chamber 4 in the coupling region between a drive-side, rotationally driven drive coupling part 7 and a driven coupling part 8, so that a high output can be achieved with the dispersion device 1 even at high temperatures and high pressures, without having to provide specially cooled shaft seals, e.g., sliding ring seals.

Figure 2:
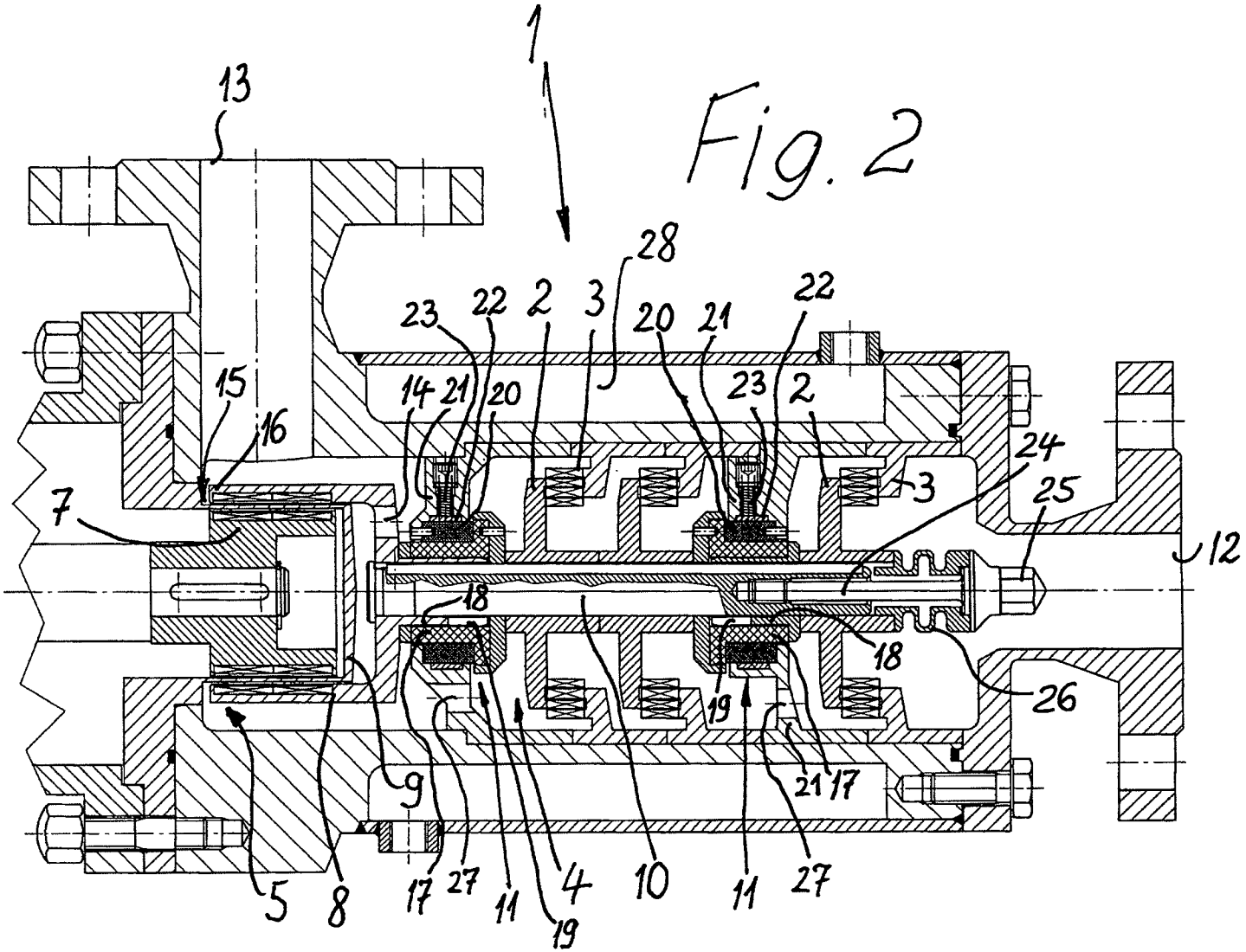
FIG. 2 is an enlarged scale, longitudinal cross-sectional view of the device according to the invention without the associated drive motor.

It can be seen primarily in FIG. 2 that the drive-side drive coupling part 7 engages as a magnetic carrier in the recessed or hollow driven-side driven coupling part 8 and is arranged between the two coupling parts of the separating can 9. The recessed or hollow driven coupling part 8 is turned toward the chamber 4 or is located in this chamber; thus it can be charged and cooled by the medium to be processed.

This outer driven coupling part 8 is connected to a drive shaft 10 located in the chamber 4 for the rotors 2, and the bearings 11 for the rotor or rotors 2 carried by the drive shaft 10 are arranged within the chamber 4 carrying a flow of medium adjacent to the rotors 2; thus the medium to be processed can flow around and cool these rotors.

Here, one can see primarily in FIG. 2 that the drive coupling part 7 is cylindrical and the driven coupling part 8 has a matching hollow cylindrical construction, so that the drive coupling part 7 can engage in the driven coupling part 8, wherein, however, as mentioned, the separating can 9 provides for hermetic separation and sealing between these two coupling parts.

If one considers the inlet opening 12 and the outlet opening 13 of the chamber 4, it becomes clear that the bearings 11 are arranged in the flow zone of the medium within the chamber 4; thus, the feeding of the medium through the chamber 4 can be charged and cooled accordingly by the medium, so that high rotational speeds are possible accordingly. In a way that is not shown in detail, for the corresponding bearings 11, at least one groove or similar impression for feeding medium to be dispersed through the corresponding bearing 11 can be provided on at least one of the bearing parts that can move relative to each other, which improves the lubricating and cooling effect.

In the illustrated embodiment it is provided that the shaft 10 arranged on the driven coupling part 8 or connected to this part has two bearings 11 and carries, between these two bearings 11, two rotors 2, as well as a third rotor 2 supported in a cantilevered manner on its end that faces away from the coupling 5 and that projects past the second bearing 11. As a whole, the dispersion device 1 contains three rotors 2 with associated stators 3, wherein two are mounted on both sides, so that only the rotor 2 that is at the front in the direction of flow and that lies closest to the inlet opening 12 is supported in a cantilevered manner. The bearing relationships are precise accordingly and the gaps between the rotors 2 and stators 3 can be narrow accordingly.

In the drawings, it can be seen that the driven coupling part 8 has at least one passage 14 or also several such passages 14 to the separating can 9 and at least one outlet 15 to the output opening 13 of the chamber 4 or the work space, so that the separating can 9 can be charged and cooled by the medium despite the driven coupling part 8 essentially enclosing it.

The outlet 15 from the driven coupling part 8 is here its opening at the free edge 16 of this driven coupling part 8, wherein the separating can 9 engages in this opening and the drive coupling part 7 engages in its interior. Thus, when the device 1 is running, the medium introduced into the driven coupling part 8 can be distributed well and uniformly to the separating can 9 and can cool this separating can.

In the preferred embodiment, the rotor shaft 10 is arranged horizontally, but it could also point upward or be arranged vertical above the drive 6 and the magnetic coupling 5, so that the inlet opening 12 into the chamber 4 or the work space would be provided above the rotors 2. This is possible due to the good hermetic sealing of the chamber 4 with the help of the separating can 9, so that the feeding of the medium through the device 1 can be supported with the help of the force of gravity and the chamber 4 can be better emptied, because it can be simply drained, which is advantageous in the case of cleaning and for the processing of products that harden while cooling.

In FIG. 2 it is shown that the bearing sleeve 17 of the corresponding bearing 11, wherein the bearing sleeve rotates with the shaft 10, is arranged on a metal connection pipe 18 that is located between it and the shaft 10 and that has, across a part of the bearing width, a somewhat increased inner diameter relative to the shaft 10 or, according to the embodiment, a slot 19 that runs in the axial direction and whose dimensions are, in particular, larger than the expansion due to heat to be expected. Thus, the different coefficients of thermal expansion of, on one hand, the bearing sleeve 17 and of, on the other hand, the shaft 10 can be compensated.

Furthermore, in FIG. 2 it can be seen that the rotors 2 and the bearing sleeves 17 of the bearing 11 are arranged coaxially one next to the other on the drive shaft 10 and are tensioned together in the axial direction by a compressive force in a way still to be described, so that simple assembly is produced. The stationary bearing bushing 20 of the corresponding sliding bearing 11, wherein this bearing bushing is similarly made from ceramic and interacts with the bearing sleeve 17, is arranged in a metallic holder 21 that can recede outward in the radial direction from the bearing bushing 20 when heated due to its greater coefficient of thermal expansion. Here it can be seen primarily in FIG. 2 on the outside of the bearing bushing 20, an outer ring 22 that is slotted or divided into multiple parts and that is pressed by a spring force onto the bearing bushing 20 by springs 23, and that is thus located between the holder 21 and the bearing bushing 20. In this way, different coefficients of thermal expansion and high temperatures can be equalized at this position.

For the already mentioned axial tensioning of the rotors 2 and the bearings 11 or their bearing sleeves 17, on the free end of the shaft 10 facing away from the magnetic coupling 5, an expansion screw 24 is provided that engages in the axial direction in the shaft and that engages with its outer threading in inner threading in the shaft 10 and that engages over, with its outer head 25, an expansion sleeve 26 in the axial direction, wherein this expansion sleeve is supported on the parts lined up on the shaft 10, that is, the rotors 2 and their bearings. In FIG. 2, one clearly sees how this expansion sleeve 26 that can be compressed in the axial direction is gripped over by the head 25 of the expansion screw 24 and allows tensioning of the parts, wherein this tensioning remains even under expansions due to heat due to the use of a correspondingly biased expansion screw 24.

It shall also be mentioned that the holders 21 of the bearings 11 have openings 27 through which the medium can be fed from the inlet opening 12 to the outlet opening 13. A heating space 28 with which the temperature in the chamber 4 can be influenced can be seen concentric to the work space or to the chamber 4.

The device 1 is used for dispersion or homogenization according to the continuous-flow principle and has at least one tool made from the rotor 2 and stator 3, preferably several such tools that are arranged one behind the other in the axial direction and that are arranged in the chamber 4 carrying a flow of the medium to be processed. The rotor or rotors 2 are driven by a motor 6 via a magnetic coupling 5, wherein, between a drive-side rotationally driven drive coupling part 7 and a driven coupling part 8, the magnetic coupling 5 has a stationary separating can 9, so that complicated, cooled shaft seals can be avoided. Here the drive coupling part 7 engages in the recessed or hollow, preferably cylindrical driven-side driven coupling part 8 and the separating can 9 is located between two coupling parts. Thus, the driven coupling part 8 and the separating can 9 can be cooled by the medium to be processed.

The invention claimed is:

1. Device (1) for dispersion or homogenization according to a continuous-flow principle, comprising at least one tool having at least two coaxial rotors (2) each provided with an associated stator (3) arranged within a chamber (4) carrying a flow of a medium to be processed, bearings for the rotors are arranged in the chamber (4) and the rotors (2) are driven by a magnetic coupling (5), the magnetic coupling (5) has a stationary separating can (9) closing the chamber (4) in a coupling region between a drive-side rotationally-driven drive coupling part (7) and a driven coupling part (8), the drive-side drive coupling part (7) engages as a magnetic carrier into a recessed or hollow of the driven-side coupling part (8), the separating can (9) is arranged between the two coupling parts and the outer driven-side coupling part (8) carries or is connected to a drive shaft (10) located in the chamber (4) for the rotors (2),and the bearings (11) for the rotors carried by the drive shaft (10) are arranged within the chamber (4) carrying a flow of the medium adjacent to the rotors (2), and at least one of the coaxial rotors is supported in a cantilevered manner with respect to one of the bearings.

2. Device according to claim 1, wherein the drive coupling part (7) is cylindrical and the driven coupling part (8) has a matching hollow cylindrical construction.

3. Device according to claim 1, wherein the bearings are arranged in a flow zone of the medium.

4. Device according to claim 1, wherein one of the bearings (11) is located on each side of at least one of the rotors (2).

5. Device according to claim 1, wherein the shaft (10) arranged on the driven coupling part (8) has two of the bearings (11) and a third one of the rotors (2), with two of the rotors being in-between the two of the bearings and the third rotor located on an end of the shaft that faces away from the coupling (5) and that projects past a second one of the bearings.

6. Device according to claim 1, wherein the driven coupling part (8) has at least one passage (14) or multiple passages to the separating can (9) and at least one outlet (15) to an output opening (13) of the chamber (4).

7. Device according to claim 6, wherein the outlet (15) on the driven coupling part (8) has an opening on a free edge (16) of the driven coupling part (8), and the separating can (9) engages in this opening.

8. Device according to claim 1, wherein the rotor shaft (10) is arranged pointing upward above the drive and the magnetic coupling (5) and the inlet opening (12) is provided in the chamber (4) above a topmost one of the rotors (2).

9. Device according to claim 1, wherein the bearings are sliding bearings, each having a bearing sleeve (17) rotating with the shaft (10) that is arranged on a metal connection pipe (18) located between it and the shaft (10), the connection pipe has, across a portion of a bearing width, at least one of an inner diameter that is somewhat enlarged relative to the shaft or at least one slot (19) running in an axial direction or at an angle to the axial direction, and a width of the slot is larger than an expansion to be expected due to heat.

10. Device according to claim 9, wherein the rotors (2) and the bearing sleeves (17) are arranged coaxially one next to the other on the drive shaft (10) and are tensioned together in an axial direction by a compressive force.

11. Device according to claim 10, wherein a stationary bearing bushing (20) of the corresponding sliding bearing (11), is made from ceramic and is arranged in a metallic holder (21) that recedes outward from the bearing bushing (20) due to a larger coefficient of thermal expansion when heated and, on an outside of the bearing bushing (20), a slotted outer ring that is divided into multiple parts is provided that is pressed by a spring force or springs (23) onto the bearing bushing (20).

12. Device according to claim 11, wherein for the axial tensioning of the rotors (2) and the bearing (11), on the free end of the shaft (10) facing away from the magnetic coupling (5), an expansion screw (24) engaging in the shaft is provided, and the screw engages over an expansion sleeve (26) that is supported on the parts lined up on the shaft (10).

13. Device according to claim 1, wherein the holders (21) of the bearings (11) have openings (27) or are formed from individual webs.

* * * * *